US007228604B2

(12) United States Patent
Hoover

(10) Patent No.: US 7,228,604 B2
(45) Date of Patent: Jun. 12, 2007

(54) SYSTEM, APPARATUS, AND METHOD OF REDUCING PRODUCTION LOSS HAVING COMPRESSOR

(75) Inventor: D. Lynn Hoover, Lake Wylie, SC (US)

(73) Assignee: American Linc Corporation, Gastonia, NC (US)

( * ) Notice: Subject to any disclaimer, the term of this patent is extended or adjusted under 35 U.S.C. 154(b) by 0 days.

(21) Appl. No.: 11/414,085

(22) Filed: Apr. 28, 2006

(65) Prior Publication Data

US 2006/0191117 A1 Aug. 31, 2006

Related U.S. Application Data

(63) Continuation-in-part of application No. 11/353,448, filed on Feb. 14, 2006, and a continuation-in-part of application No. 10/717,181, filed on Nov. 19, 2003, now Pat. No. 7,152,287.

(51) Int. Cl.
*D02G 1/20* (2006.01)

(52) U.S. Cl. ..... 28/220; 28/221; 28/247; 28/263

(58) Field of Classification Search ..... 28/220, 28/221, 263, 247, 254, 255, 258, 262, 264–266, 28/269, 289, 270; 57/332–334, 351, 284; 226/196.1, 170

See application file for complete search history.

(56) References Cited

U.S. PATENT DOCUMENTS 3,108,352 A * 10/1963 Haigler et al. ..... 28/266
3,123,889 A * 3/1964 Watts ..... 28/289
3,144,687 A * 8/1964 Skalko et al. ..... 19/145.5
3,147,533 A * 9/1964 Baer ..... 28/258
3,166,821 A * 1/1965 Furlong ..... 28/251
3,302,839 A * 2/1967 Spruill ..... 242/615.4
3,341,911 A * 9/1967 Smith ..... 28/266
3,406,436 A * 10/1968 Clarke, Jr. ..... 28/250
3,439,394 A * 4/1969 Gray et al. ..... 28/221
3,516,241 A * 6/1970 Nakano et al. ..... 28/269
3,780,405 A * 12/1973 Izawa et al. ..... 28/248
3,881,230 A * 5/1975 Arnold et al. ..... 28/263
3,882,578 A * 5/1975 Izawa ..... 28/266
H000020 H * 2/1986 Nunn et al. ..... 28/263
5,483,730 A * 1/1996 Hoover ..... 28/289
6,302,308 B1 * 10/2001 Hoover et al. ..... 28/266
6,481,072 B1 * 11/2002 Hoover et al. ..... 28/263

* cited by examiner

*Primary Examiner*—Amy B. Vanatta
(74) *Attorney, Agent, or Firm*—Bracewell & Giuliani, LLP

(57) ABSTRACT

A yarn texturizing system, apparatus, and methods of reducing production loss or increasing production speed in a continuous textured yarn production process are provided. The system includes a yarn texturizer to texturize yarn, a chute positioned to receive and guide the texturized yarn in the form of a bundle of texturized yarn from the yarn texturizer, a yarn compressor positioned to compress the texturized yarn against an upper surface of the chute at least after being initially received from the yarn texturizer, and a yarn conveyor positioned to convey the compressed texturized yarn.

25 Claims, 14 Drawing Sheets

SYSTEM, APPARATUS, AND METHOD OF REDUCING PRODUCTION LOSS HAVING COMPRESSOR

RELATED APPLICATIONS

This application is a continuation-in-part application which claims the benefit of and priority to U.S. Non-Provisional patent application Ser. No. 10/717,181, filed on Nov. 19, 2003 now U.S. Pat. No. 7,152,287, and U.S. Non-Provisional patent application Ser. No. 11/353,448, filed on Feb. 14, 2006, both of which are incorporated herein by reference in its entirety.

BACKGROUND OF THE INVENTION

1. Field of the Invention

The present invention relates to the textile industry and, more particularly, to systems, devices, and methods of producing textured yarn.

2. Description of Related Art

In the textile industry, various systems have been developed over the years to textured yarn in a high speed, continuous production process such as for use in carpet related products or other textile products. These systems often include a yarn supply, a false twister positioned downstream from the yarn supply to impact a false twist to the yarn to enhance cohesiveness, one or more draw rolls positioned downstream from the false twister, a stuffer box or can to crimp or otherwise form a texture in the yarn, a yarn conveyor belt positioned downstream from the stuffer box and positioned to receive the textured yarn thereon to convey the textured yarn downstream, a bulker positioned to receive the yarn conveyor and to initially heat bulk the textured yarn, a yarn conveyor retainer band positioned to overlie the bulked textured yarn to enhance retaining the bulked textured yarn on the yarn conveyor belt, a heat setting oven positioned to receive the yarn conveyor belt having the retained and bulked textured yarn, a yarn cooler, e.g. a fan(s), positioned downstream from the heat setting oven to cool the textured yarn, and a yarn take-up positioned downstream from the yarn cooler and the heat setting oven to take-up the yarn from the yarn conveyor belt.

In these prior art systems, much emphasis has been placed over the years on various crimping or texturizing containers and methods prior to depositing the textured yarn onto the conveyor belt. For example, some devices focus on spreading out the textured or crimped yarn onto the conveyor prior to entering the heat setting oven. Other devices have focused on receiving crimped yarn or tow from the stuffer box and deposit it in a uniform manner or standing up on the conveyor belt.

The present applicant, however, has recognized that despite these changes or developments in the production of textured yarn, the speed of producing textured yarn can be significantly slower than other types of yarn production, such as straight set. It is thought that this difference in some circumstances can be as much as 20% slower for textured production than for straight set production. As a result, more labor, more production shifts, longer production times, and/or more machine wear and tear can be required to achieve desired textured yarn production results. Applicant therefore has recognized a need to reduce production loss and increase production speed for textured yarn, especially in continuous textured yarn production processes.

SUMMARY OF THE INVENTION

In view of the foregoing, embodiments of the present invention advantageously provide a system, apparatus, and methods to substantially reduce production loss for textured yarn. Embodiments of the present invention also advantageously provide a system, apparatus, and methods of increasing production speed of textured yarn in a continuous production process. Embodiments of the present invention additionally advantageously provide a system, apparatus, and methods that significantly increase the amount of textured yarn mass that can be positioned in the same physical space such as on a conveyor belt of a selected width in a continuous production process.

Embodiments of the present invention further advantageously provide a system, apparatus, and methods of reducing production loss in textured yarn that are readily compatible with existing continuous textured yarn production processes without the necessity of replacing an entire continuous production process system.

Still further, embodiments of the present invention advantageously provide a system, apparatus, and method of doing business which allow a textured yarn manufacturer or other textured yarn textile product producer to significantly reduce the amount of labor, production shifts, production times, and/or machine wear and tear. Embodiments of the present invention yet further provide a system, apparatus, and methods to enhance control of a continuous textured yarn production process by analyzing the production process as a whole and substantially synchronizing one or more drives for various devices within a production system. Embodiments of the present invention yet further still provide a system, apparatus, and methods of reducing production loss in textured yarn that includes compression of the textured yarn within a selected physical space, e.g., when positioned on a conveyor belt of a preselected width, prior to heat setting the textured yarn.

More particularly, an embodiment of the present invention advantageously provides a yarn texturizing system including a yarn texturizer, or draw rolls and a stuffer box, to texturize yarn, and a chute positioned to receive and guide the texturized yarn in the form of a bundle of texturized yarn from the yarn texturizer. A yarn compressor is positioned to compress the texturized yarn against an upper surface of the chute at least after being initially received from the yarn texturizer. A yarn conveyor is positioned to convey the compressed texturized yarn.

The system can also include that the yarn compressor is further positioned adjacent the yarn conveyor, and a heat setting oven is positioned to receive compressed texturized yarn when positioned on the yarn conveyor and moving to the heat setting oven to be heat set therein. The system can also include that the yarn compressor is positioned within at least a portion of the chute.

The compressor can also be included as a component of a yarn compressor assembly, and the yarn compressor assembly includes a motor drive that selectively drives the compressor. The compressor assembly also includes a compressor wheel that compresses the texturized yarn passing through the guide chute by rotating with an outermost circumference of the compressor wheel being positioned a preselected distance from the upper surface of the chute carrying the texturized yarn. The compressor wheel can include a plurality of undulations substantially and uniformly positioned along an outer periphery of the surface of the compressor wheel. The undulations can include a plurality of compressor ridges and compressor valleys, each compressor valley being formed between each pair of adjacent compressor ridges, and the compressor ridges defining the outermost circumference of the compressor wheel. The compressor ridges and valleys can also extend transverse to an axis A of the chute. The compressor ridges and valleys can extend in a predetermined pattern to spread the bundle of the texturized yarn more uniformly across a width of the chute.

The chute can also have a spacer vane positioned to spread the bundle of the texturized yarn prior to the bundle of texturized yarn being compressed. The spacer vane can include a pair of inclined surfaces extending upward and forming an apex that extends along an axis of the chute. The chute can be positioned to extend between a proximal end adjacent the yarn texturizer and a distal end adjacent the conveyor, and wherein the chute is inclined at an angle in the range of about 20 to about 45 degrees relative to the conveyor to help carry the texturized yarn from the yarn texturizer to the conveyor. The chute can also have an angle adjustor, which operably adjusts the angle the chute is inclined relative to the conveyor.

The system can also include a yarn bulker positioned adjacent the yarn conveyor, between the yarn compressor and the heat setting oven, to impart bulking of the bundle of compressed and spread texturized yarn prior to entering the heat setting oven.

More particularly, an embodiment of the present invention also advantageously provides a yarn compressor assembly for use with a yarn texturizing system. The yarn compressor assembly includes a chute adapted to receive a bundle of texturized yarn from a yarn texturizer and guide the bundle of texturized yarn to a conveyer. The yarn compressor assembly also includes a motor-driven compressor positioned to compress texturized yarn when passing through the guide chute, the compressor has a compressor wheel that compresses the bundle of texturized yarn passing through the chute by rotating with an outermost circumference of the compressor wheel a preselected distance from an upper surface of the chute carrying the bundle of texturized yarn.

The yarn compressor assembly can also include that the compressor wheel has a plurality of undulations substantially and uniformly positioned along an outer periphery of the surface of the compressor wheel. The undulations can include a plurality of compressor ridges and compressor valleys, with each compressor valley being formed between each pair of adjacent compressor ridges, and the compressor ridges defining the outermost circumference of the compressor wheel. The yarn compressor assembly can also include that the compressor ridges and valleys extend transverse to an axis of the chute. The yarn compressor assembly can further include that the compressor ridges and valleys extend in a predetermined pattern to spread the bundle of texturized yarn more uniformly across a width of the chute.

The yarn compressor assembly can also include that the chute has a spacer vane positioned to spread the bundle of texturized yarn prior to the texturized yarn being compressed by the compressor wheel, and that the spacer vane includes a pair of inclined surfaces extending upward and forming an apex that extends along an axis of the chute. The yarn compressor assembly can include that the chute is positioned to extend between a proximal end adjacent the yarn texturizer and a distal end adjacent the conveyor, and that the chute is inclined at an angle in the range of about 20 to about 45 degrees relative to the conveyor to help carry the texturized yarn from the yarn texturizer to the conveyor. The yarn compressor assembly can also include that the chute includes an angle adjustor, which operably adjusts the angle the chute is inclined relative to the conveyor. The yarn compressor assembly can also include that the chute has a pair of sidewalls extending from the upper surface of the chute, and that the compressor wheel has about one-eighth of an inch clearance from the sidewalls so that the compressor wheel compresses the bundle of texturized yarn.

Embodiments of the present invention also advantageously include a method of controlling and increasing through put within a yarn texturizing system. The method includes carrying a bundle of texturized yarn through a chute extending between a yarn texturizer and a yarn conveyor. The method also includes compressing the bundle of texturized yarn, e.g. with a compressor, being carried through the chute. The method also includes spreading the bundle of texturized yarn, e.g. with the undulations on the compressor wheel or with the spacer vane, so that a width of the bundle of texturized yarn prior to being received by and carried through the chute is less than a width of the bundle of texturized yarn exiting the chute. The method also includes conveying the compressed and spread texturized yarn, e.g. with the conveyor belt, to a heat setting oven, and then heat setting the compressed and spread texturized yarn.

The method can further include that the compressing step includes supplying a compressor positioned closely adjacent an upper surface of the chute so that the bundle of texturized yarn compresses when contacting the compressor. The method can also include that the compressor has a compressor wheel with undulations formed around the outer periphery of the compressor wheel so that the undulations compress and spread the bundle of texturized yarn. The method can further include controlling a preselected distance from each edge of the conveyor that the compressed and spread texturized yarn is positioned by defining a width of the chute that is less than a width of the conveyor, and substantially uniformly spreading the bundle of texturized yarn across the width of the chute during the spreading step.

By providing a system, apparatus, and methods of reducing production loss in textured yarn, yarn manufacturers can significantly reduce production losses associated with textured yarn production systems and processes. In turn, this saves time, money, and labor and substantially increases flexibility for a manufacturer such as associated with scheduling needs, meeting customer demands, and the ability to attempt to produce various types of customized textured yarn or textile products. Such a system, apparatus, and methods of embodiments of the present invention also advantageously allow a textured yarn manufacturer to increase production speed and/or decrease production loss and yet only pay for such enhancements if money is saved by the manufacturer.

BRIEF DESCRIPTION OF THE DRAWINGS

Some of the features and advantages of the present invention having been stated, others will become apparent as the description proceeds when taken in conjunction with the accompanying drawings, in which.

DETAILED DESCRIPTION

The present invention now will be described more fully hereinafter with reference to the accompanying drawings in which illustrated embodiments of the invention are shown. This invention, however, may be embodied in many different forms and should not be construed as limited to the illustrated embodiment set forth herein; rather, these embodiment are provided so that this disclosure will be thorough and complete, and will fully convey the scope of the invention to those skilled in the art. Like numbers refer to like elements throughout.

Figure 16:
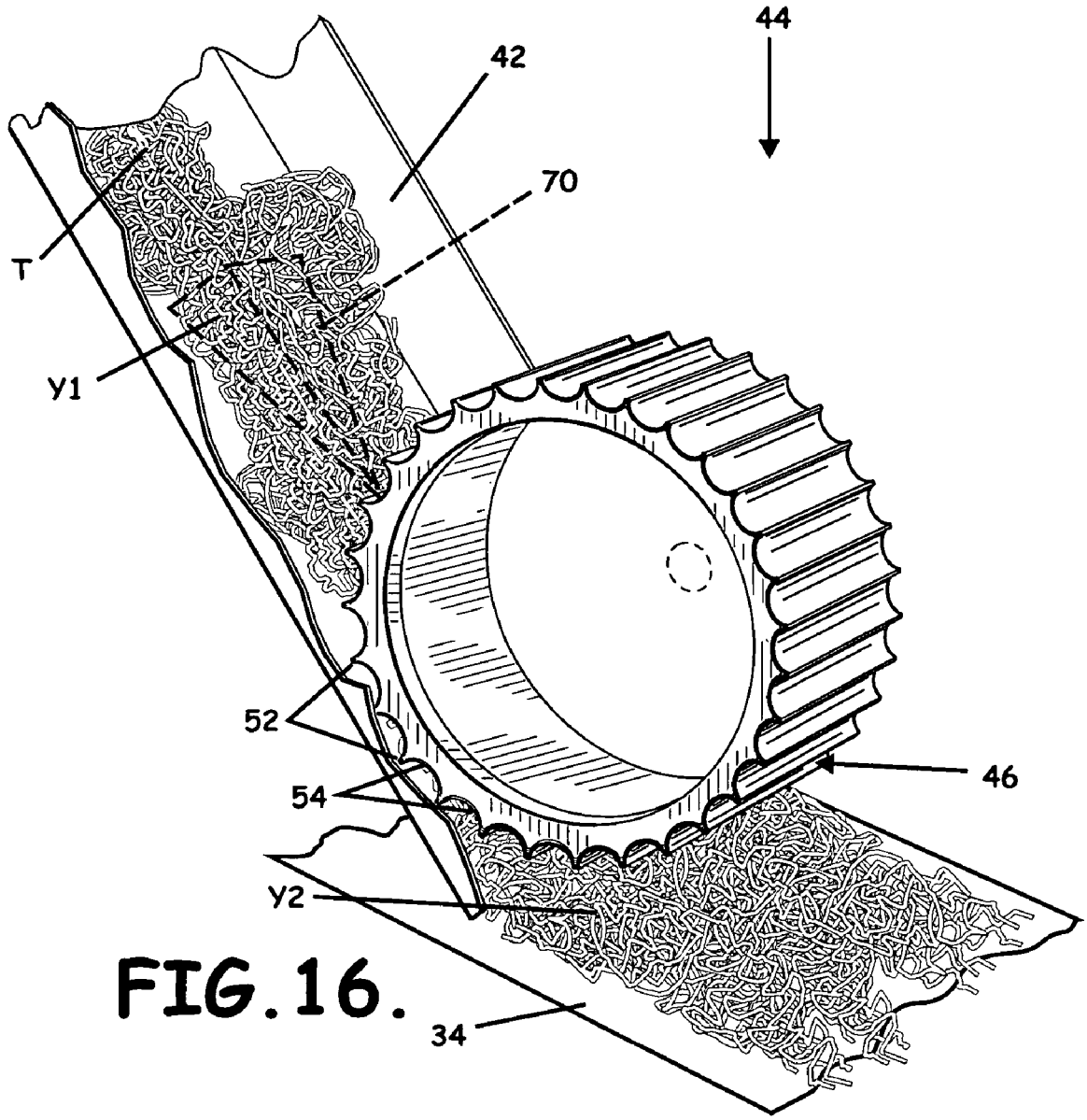
FIG. 16 is an enlarged perspective view of an embodiment of a compressor assembly of a system to reduce production loss in textured yarn according to an embodiment of the present invention.
Figure 17:
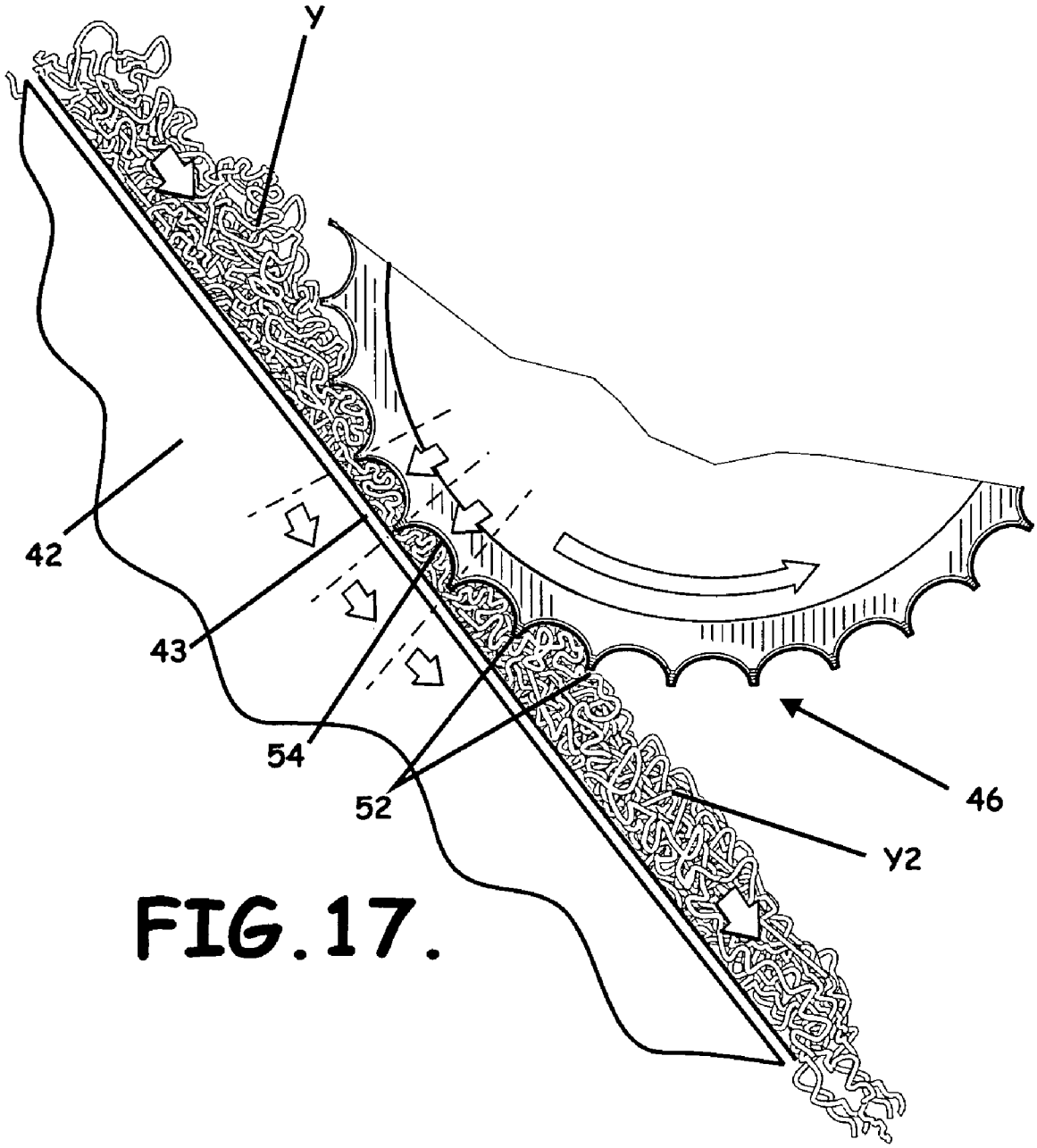
FIG. 17 is an enlarged fragmentary side elevational view of a system compressor assembly of a system to reduce production loss in textured yarn according to an embodiment of the present invention.
Figure 18:
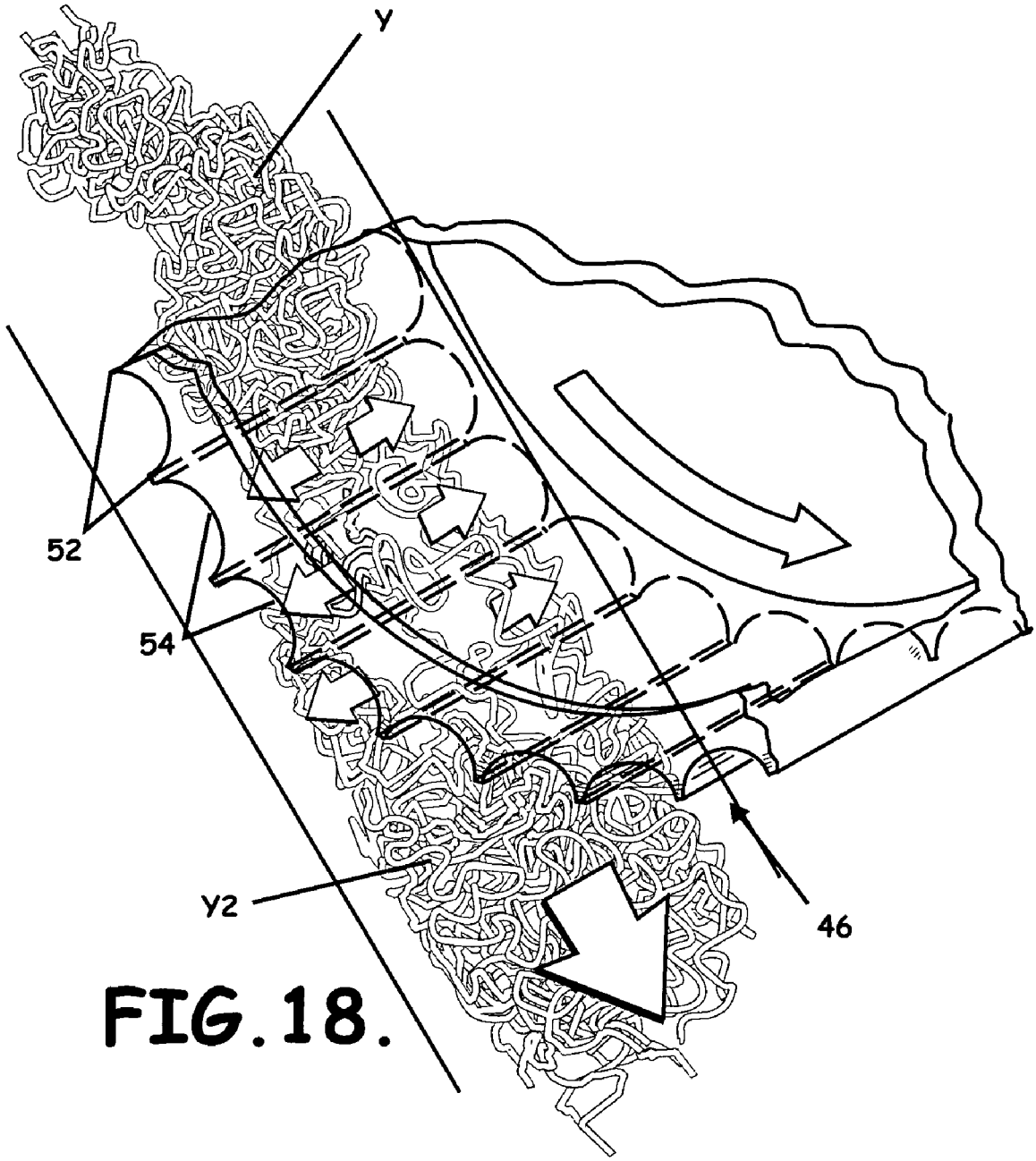
FIG. 18 is an enlarged perspective view of a system compressor assembly of a system to reduce production loss in textured yarn according to an embodiment of the present invention.

FIGS. 1-2 and 4-5 illustrate an embodiment of a yarn texturizing system 30 to reduce the production loss in textured yarn T and, particularly, in a high speed, continuous textured yarn production process. The system 30 includes a yarn supply 20 or yarn feed having yarn Y, e.g., untextured yarn or tow, positioned thereon, a yarn guide 22 guidingly receiving a plurality of yarn strands therethrough, a yarn texturizer (e.g., draw rolls 25 and a stuffer box 26) positioned downstream from the yarn supply 20 to impart a false twist to the yarn Y so that cohesiveness among strands or sliver is enhanced, and a yarn stuffing container 26, e.g., a stuffer box or can as understood by those skilled in the art, (see FIG. 16) positioned downstream from the yarn supply 20 to receive the yarn Y from the yarn supply 20, i.e., through the false twister 24, so that the received yarn Y is stuffed within the yarn stuffing container 26 and periodically released therefrom in a crimped position to thereby define textured yarn T. As understood by those skilled in the art, the periodical release from textured yarn T from the stuffing container 26 can be by accumulated pressure on a pivoting door 29 (see FIG. 5), by timingly opening of a closure such as a door or valve by a controller 60 or other device, or by other techniques as understood by those skilled in the art. The system 30 also includes a yarn draw 25, e.g., one or more draw rolls, positioned downstream from the yarn supply 20 to draw the yarn Y to the yarn-stuffing container 26, i.e., through the false twister 24, at a selected speed. The yarn draw 25 and other drive related components of the system 30 are preferably controlled by a controller 60, e.g., an industrial controller having stored program control, a computer, or other controller as understood by those skilled in the art, which interfaces with or otherwise communicates with one or more motors to control the drive of the draw rolls 25 and other components of the system, e.g., the false twister 24, a conveyor belt 34, a compressor 40, a yarn bulker 36, a heat set oven 38, a yarn cooler 27, and a yarn take-up 28, as understood by those skilled in the art.

As shown in FIGS. 1-2, 4-11, and 16-18, the system 30 also includes a yarn conveyor belt 34, transfer belt, or other yarn transporter positioned downstream from the yarn stuffing container 26 to receive the textured yarn thereon and a yarn compressor 40 positioned between the yarn stuffing container 26 and the yarn conveyor belt 34 to compress the bundle of textured yarn T prior to being received on the yarn conveyor belt 34, so that the textured yarn after passing through compressor 40 defines a bundled of textured yarn Y2 that is then deposited onto the yarn conveyor belt 34 as illustrated. The bundle of textured yarn Y2 is advantageously compressed or compacted and spaced substantially uniformly across the width of the bundle of textured yarn Y2 in response to being compressed by the compressor 40.

The yarn compressor 40 preferably is a component of a compressor assembly 44, which includes other components such as a motor drive 48, a compressor wheel 46 that is driven by the motor drive 48, and chute 42 having an upper surface against which the bundle of textured yarn T is compressed against by the compressor wheel 46. The chute 42 is advantageously positioned to extend between a proximal end adjacent the stuffer box 26 and a distal end adjacent the conveyor belt 34. The motor drive 48 can advantageously be a variable-speed motor, the operational speed of which being controlled by control 60. Motor drive 48 preferably rotates compressor wheel 46 at substantially the same speed as the conveyor belt 34. As will be readily appreciated by those skilled in the art, motor drive 48 drives compressor wheel 46 through a direct coupling, in which the compressor wheel 46 rotates at substantially the same speed as the drive shaft of the motor drive 48, or through a ratio speed coupling assembly such as a gear box or belt assembly. The compressor wheel 46 preferably includes a hub 49 for connection with the motor drive 48. The compressor assembly 44 also preferably includes a cover 62 that covers an upper portion of the chute 42 and the compressor wheel 46. In the preferred embodiment, the cover 62 is transparent to advantageously protect the operator from injury while being able to observe the flow of the texturized yarn through the compressor assembly 44. The cover 62 is advantageously rotationally fixed to the distal end of the chute 42 so that the cover 62 can easily access the interior portions of the chute 42 and the compressor wheel 46 that are covered by the cover 62 during operations.

Figure 6:
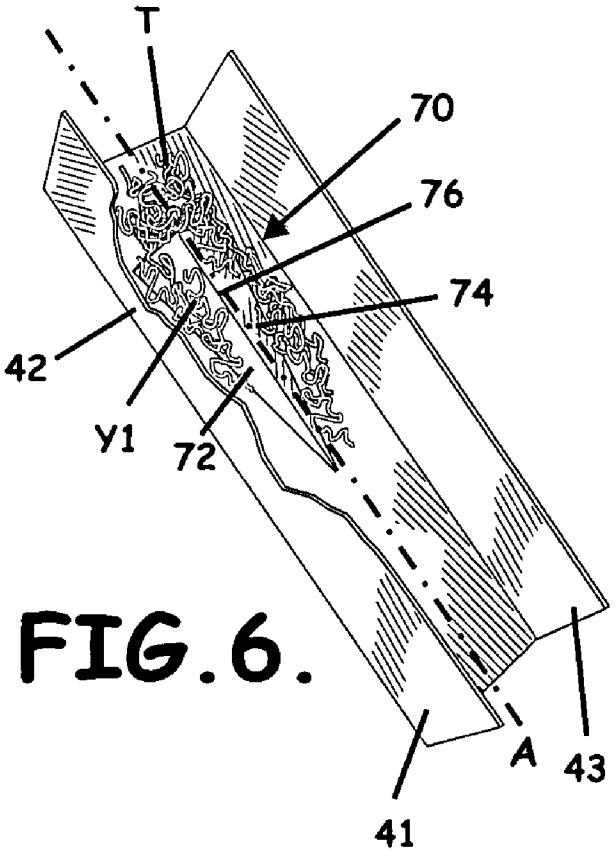
FIG. 6 is a perspective view of an embodiment of a chute with a spacer vane of a compressor assembly of a system to reduce production loss in textured yarn according to an embodiment of the present invention.
Figure 7:
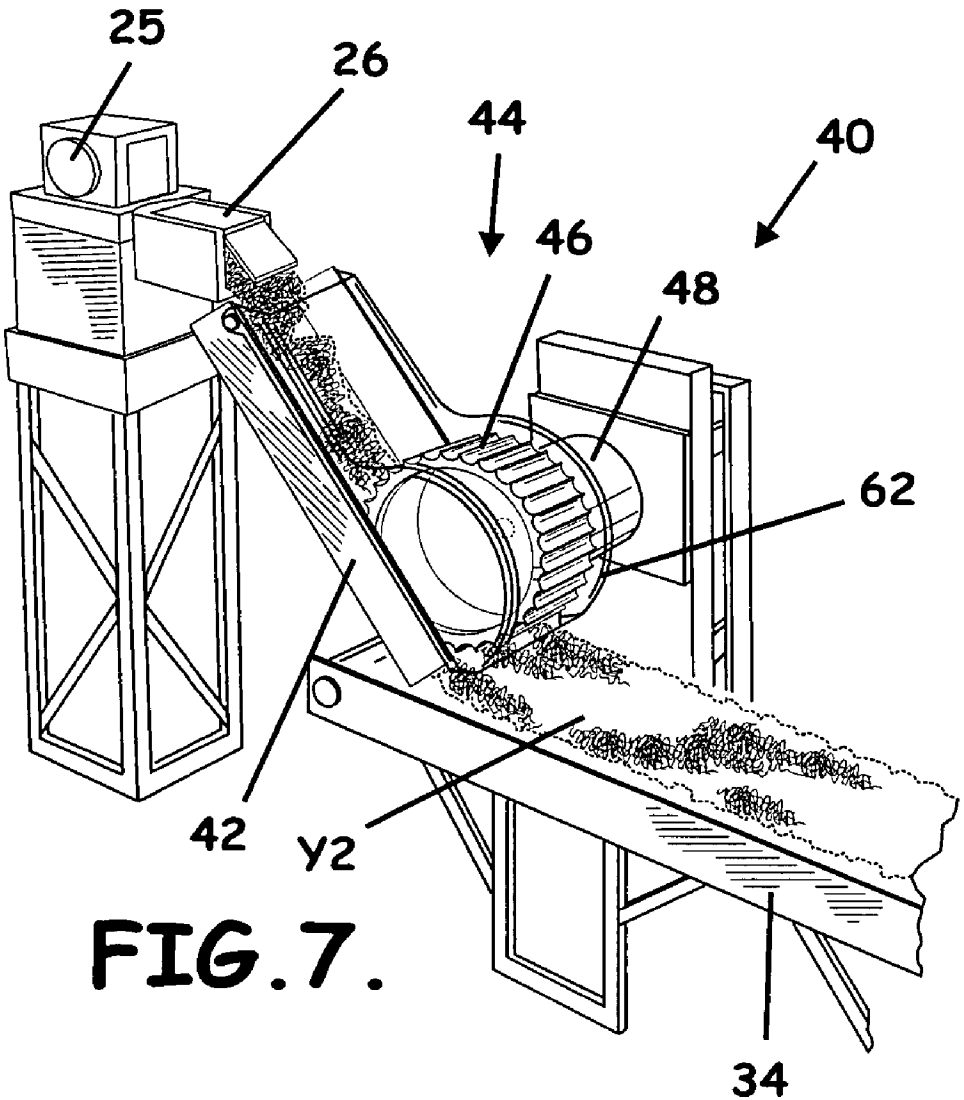
FIG. 7 is a perspective view of an embodiment of a system to reduce production loss in textured yarn according to an embodiment of the present invention.
Figure 9:
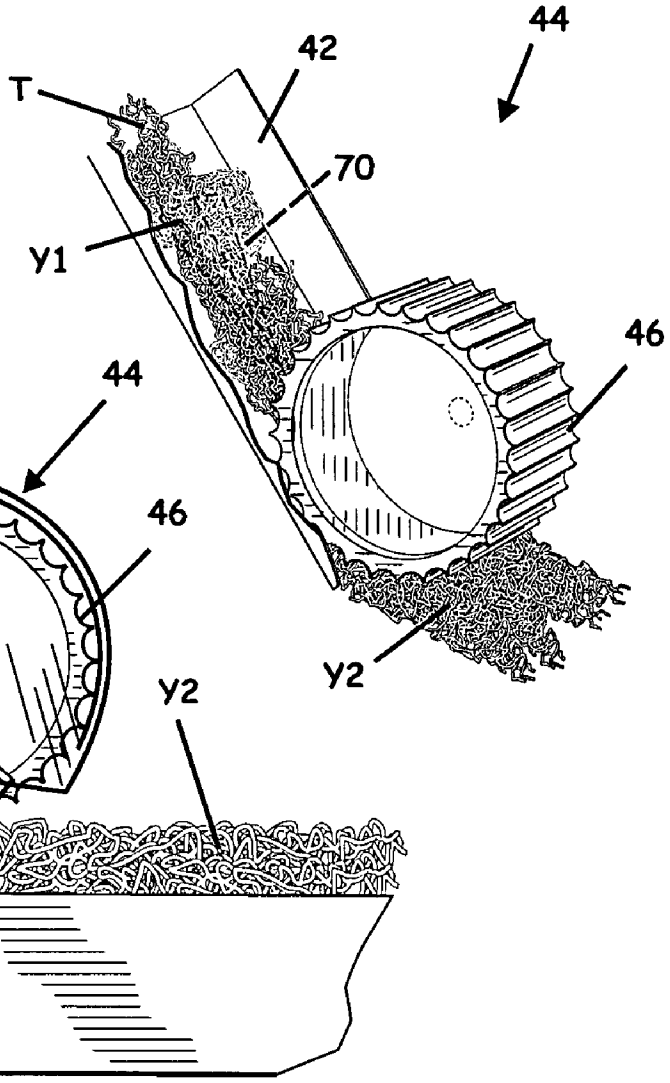
FIG. 9 is a perspective view of an embodiment of a compressor assembly of a system to reduce production loss in textured yarn according to an embodiment of the present invention.
Figure 8:
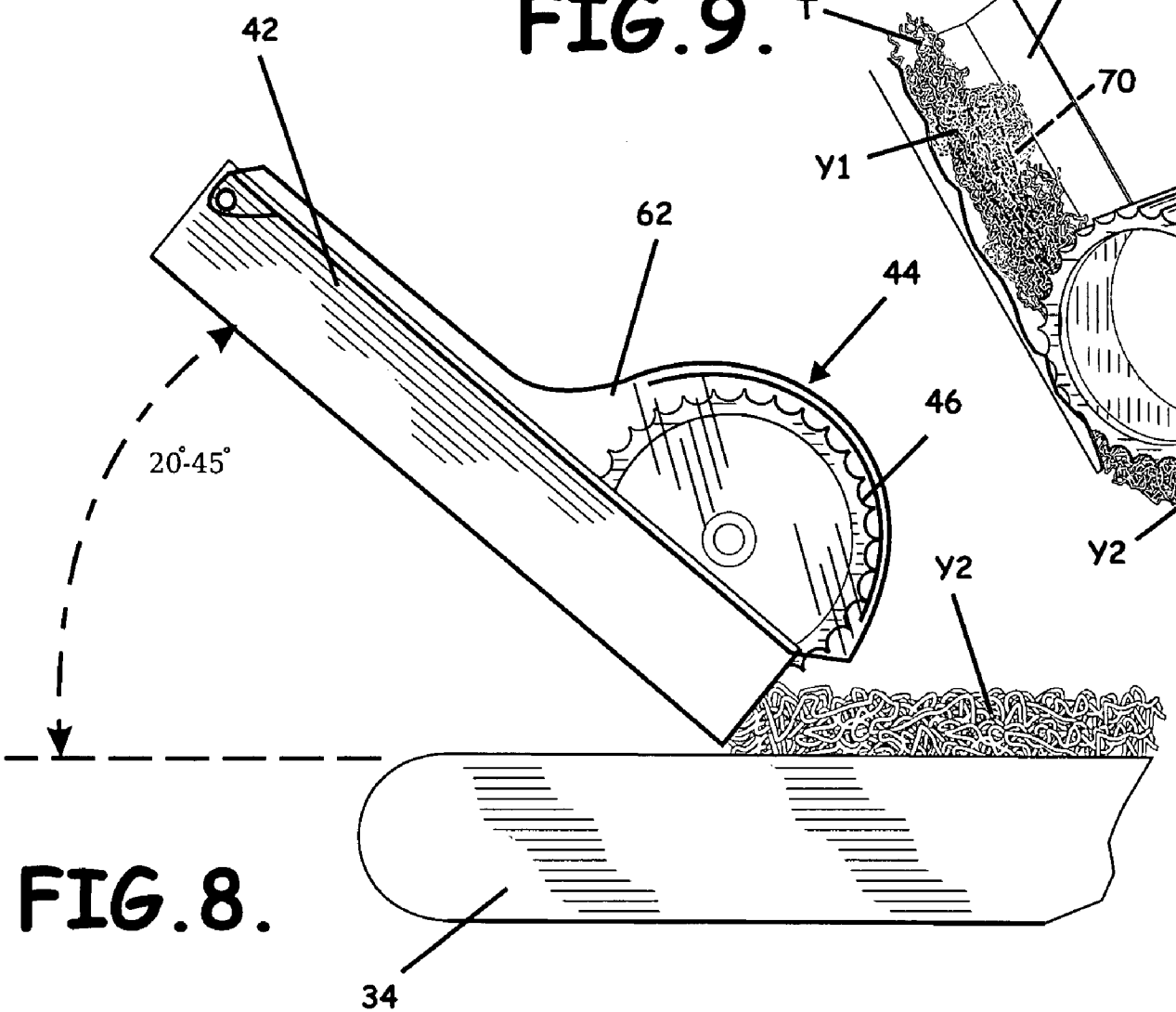
FIG. 8 is a side elevational view of an embodiment of a compressor assembly of a system to reduce production loss in textured yarn according to an embodiment of the present invention.
Figure 10:
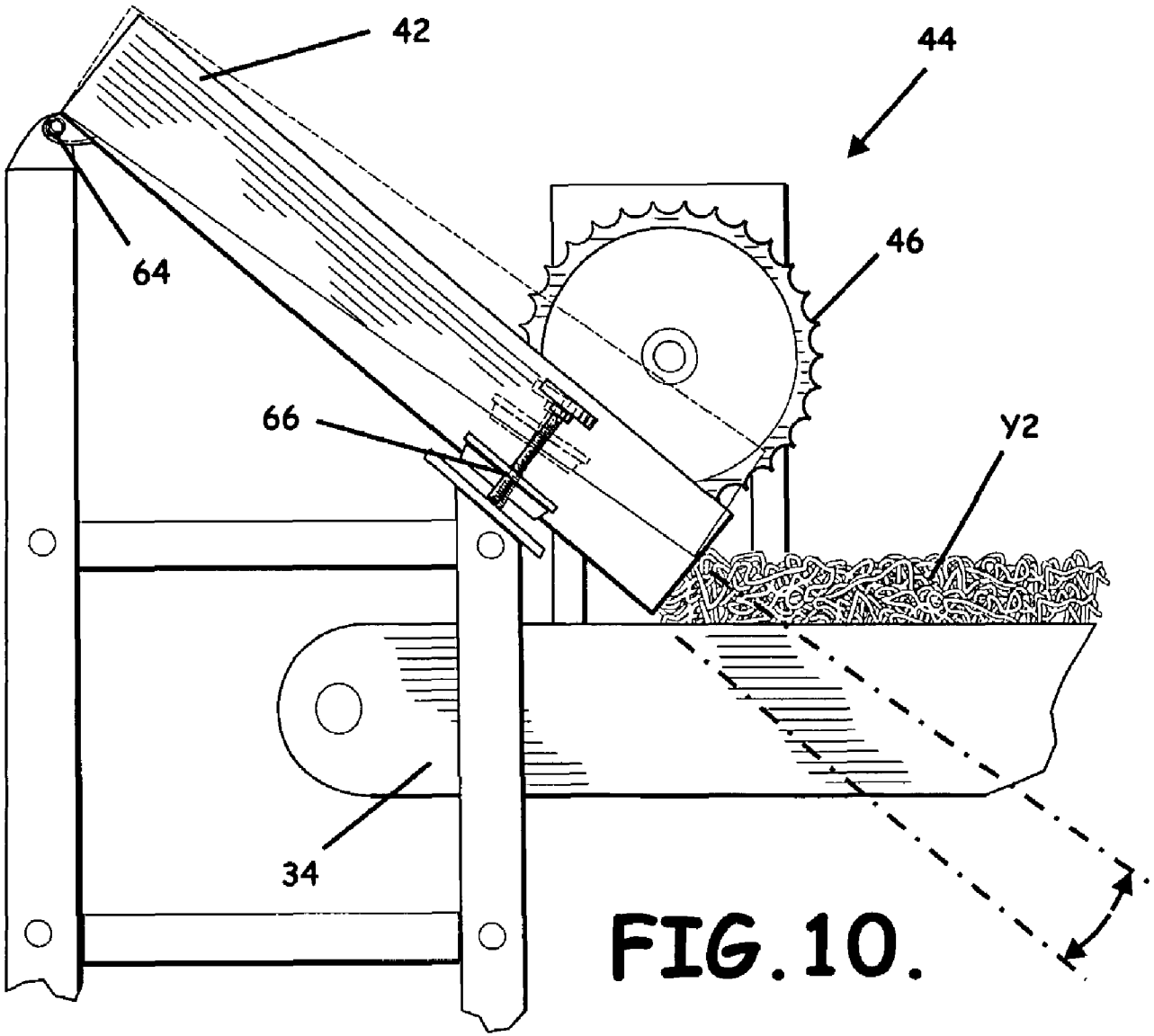
FIG. 10 is a side elevational view of an embodiment of a compressor assembly of a system to reduce production loss in textured yarn according to an embodiment of the present invention.
Figure 11:
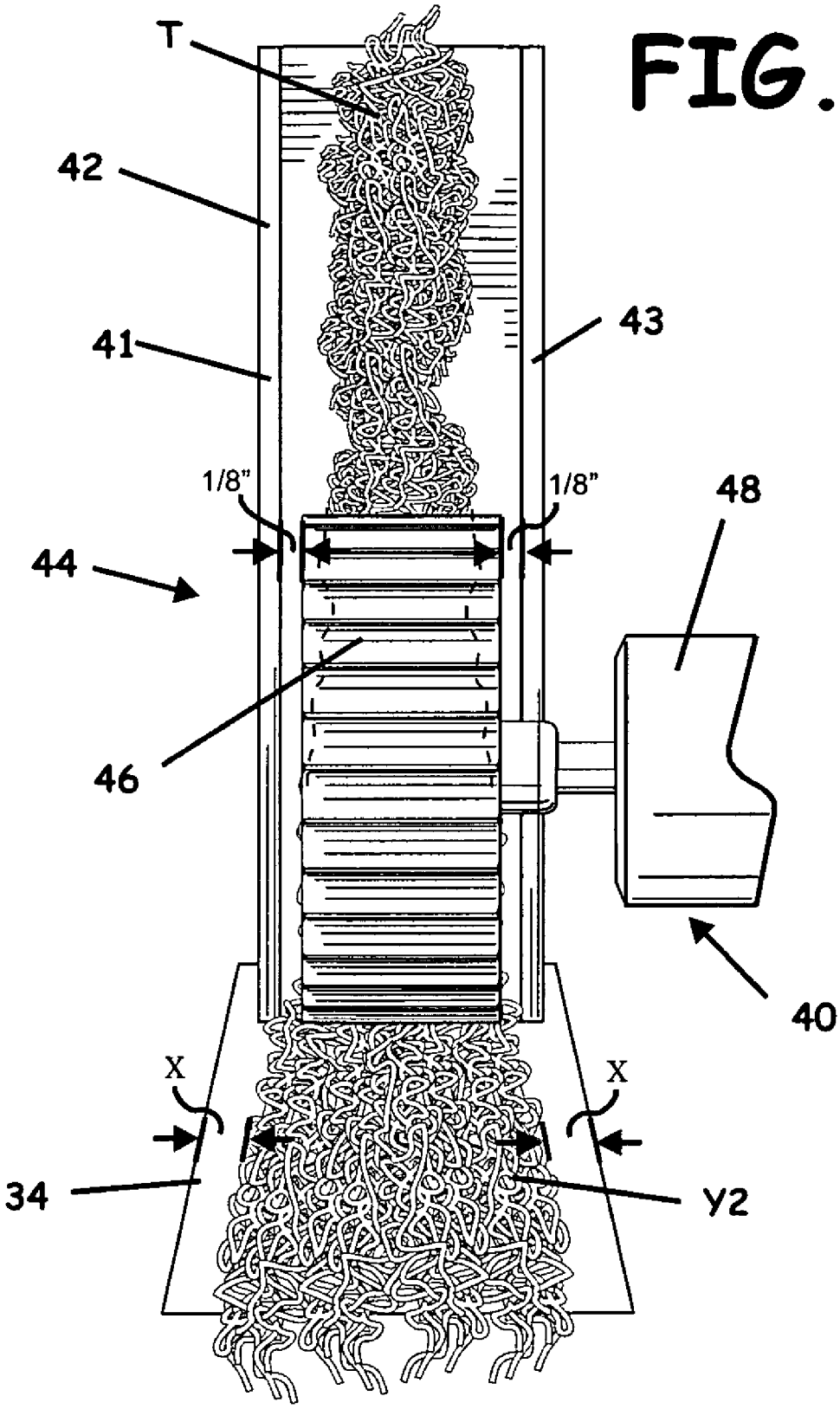
FIG. 11 is a perspective view of an embodiment of a compressor assembly of a system to reduce production loss in textured yarn according to an embodiment of the present invention.
Figure 12:
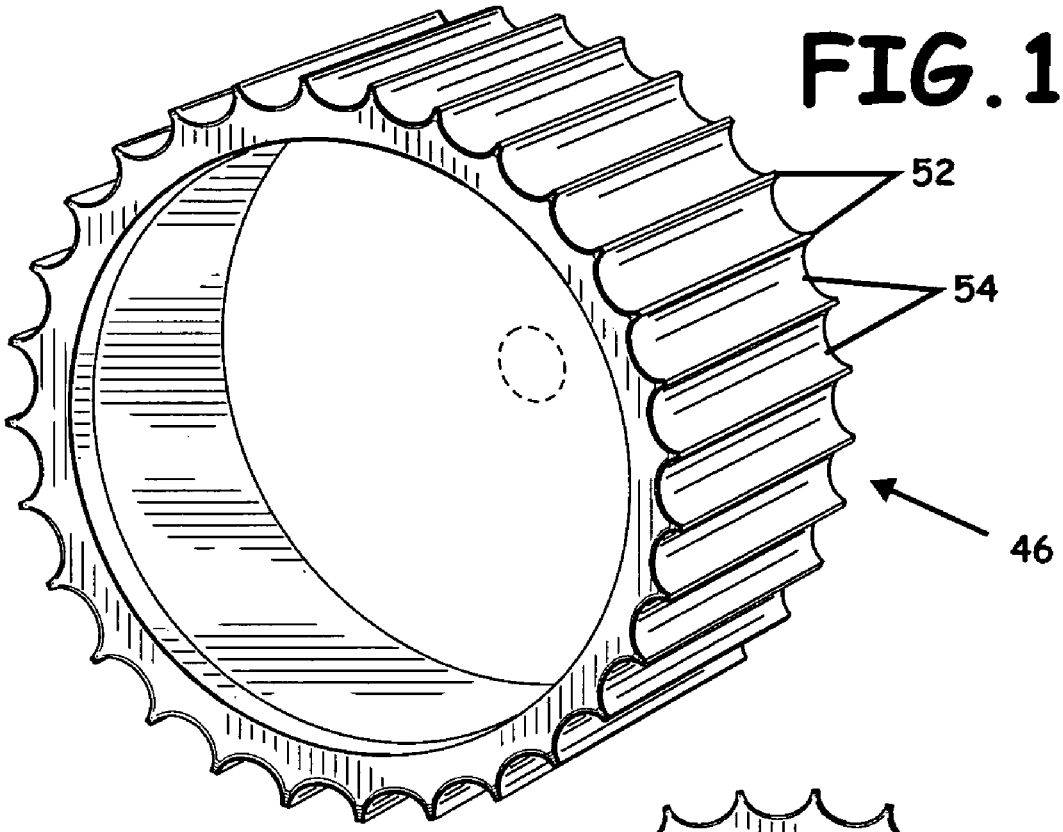
FIG. 12 is a perspective view of an embodiment of a compressor wheel of a system to reduce production loss in textured yarn according to an embodiment of the present invention.
Figure 13:
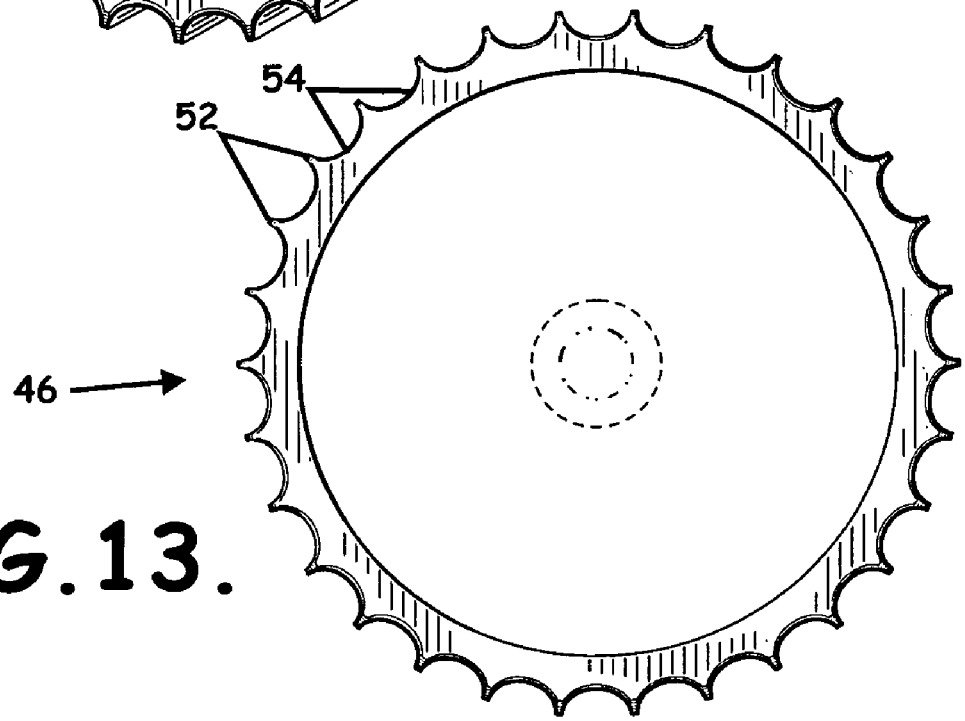
FIG. 13 is a front side elevational view of an embodiment of a compressor wheel of a system of reducing production loss in textured yarn according to an embodiment of the present invention.
Figure 14:
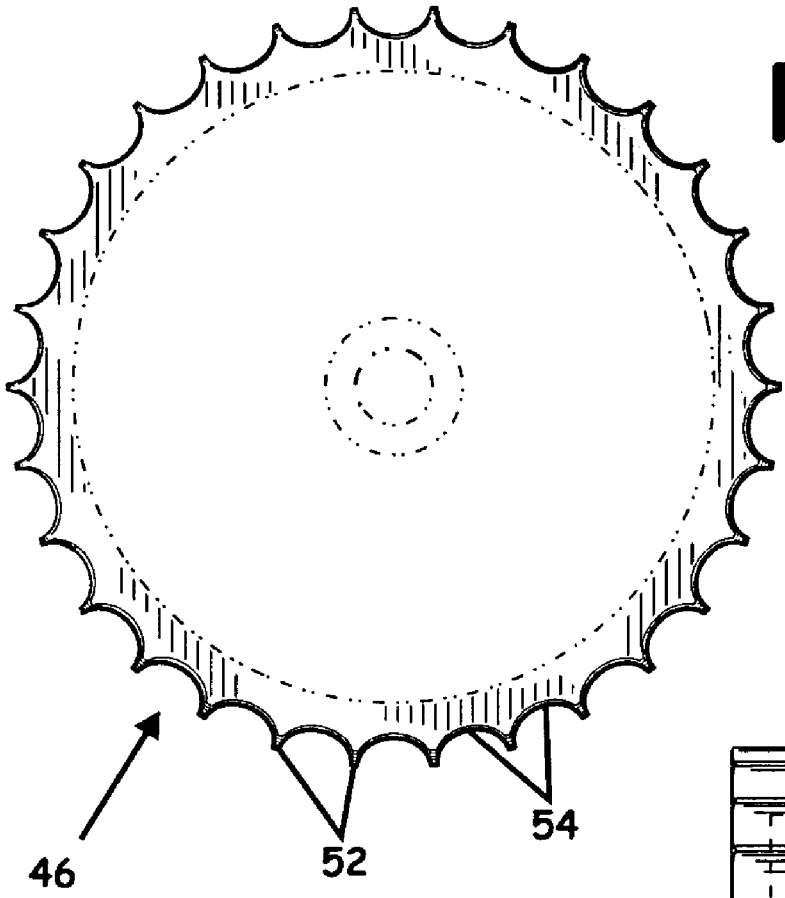
FIG. 14 is a rear side elevational view of an embodiment of a compressor wheel of a system of reducing production loss in textured yarn according to an embodiment of the present invention.
Figure 15:
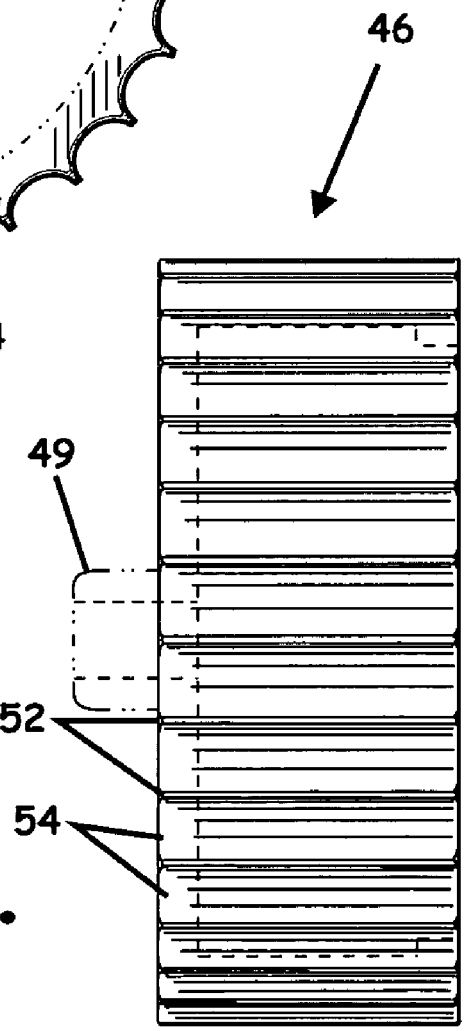
FIG. 15 is a top plan view of an embodiment of a compressor wheel of a system of reducing production loss in textured yarn according to an embodiment of the present invention.

As best illustrated in FIG. 6, the chute 42 can include a spacer vane 70 that initiates a spreading of the bundle of texturized yarn T, thereby defining an initially spread bundle of texturized yarn Y1 prior to engaging the compressor wheel 46. The spacer vane 70 preferably includes a pair of inclined surfaces 72,74 extending at angles from the upper surface of the chute 42, and defining an apex 76. In the preferred embodiment, the apex 76 extends substantially along an axis A of the chute 42. In operation, as the bundle of texturized yarn T communicates through the upper portion of the chute 42, the bundle of texturized yarn T engages the spacer vane 70 positioned within the chute 42. The bundle of texturized yarn T begins to spread along the inclines of inclined surfaces 72,74 toward the sidewalls 41,43 of the chute 42. After engaging and being spread or spaced within the chute 42 by the spacer vane 70, the initially spread bundle of texturized yarn Y1 advantageously has a greater width than the bundle of texturized yarn T. As will be readily appreciated by those skilled in the art, the spacer vane 70 helps to optimally position the initially spread bundle of texturized yarn Y1 for compression by the compressor wheel 46.

The compressor wheel 46 can be, for example, an aluminum wheel having a hard coating or other yarn handling surface, i.e., stainless steel, Teflon, on the outer peripheries thereof. As best illustrated in FIGS. 4-5, and 7-18, the compressor wheel of the preferred embodiment includes a plurality of undulations substantially and uniformly positioned along an outer periphery of the surface of the compressor wheel 46. The plurality of undulations define a series of intermittently spaced ridges 52 and valleys 54. The ridges 52 preferably defining the outermost circumference of the compress wheel 46. In the preferred embodiment, the ridges 52 and valleys 54 extend transverse to the axis A of the chute 42. The ridges 52 and valleys 54 also advantageously extend in a predetermined pattern to spread the bundle of the texturized yarn T, Y1 more uniformly across a width of the chute 42 so that the bundle of compressed and spread texturized yarn Y2 has a width X that is substantially uniform across the entire width of the chute 42. Having a uniform spreading or spacing of the bundle of compressed and spread texturized yarn Y2 helps to facilitate optimal use of the conveyor belt 34 and allows the conveyor belt 34 to operate at higher speeds with less risk of snagging the yarn being carried thereon. The spreading and spacing of the texturized yarn also enhances the ability to control the positioning of the bundle of compressed and spread texturized yarn Y2 on the conveyor belt 34. While the preferred embodiment of compressor wheel 46 is illustrated with the substantially uniform undulations, the compressor wheel 46 can be designed in various ways to compress and spread the texturized yarn. For example, those skilled in the art can easily appreciate that compression and spreading could be accomplished with various patterns of uniform undulations, patterns of non-uniform undulations, and even surfaces without undulations (e.g., an arcuate contact surface with the apex of the arc rotating along the axis A, or a surface coating on a substantially smooth surface that induces spreading).

As is perhaps best illustrated in FIGS. 5-11, the chute 42 preferably includes a pair of sidewalls 41,43 extending upward from the upper surface of the chute 42 that enhance the control of the flow of the texturized yarn T,Y1,Y2. The chute 42, positioned to extend between a proximal end adjacent the false twister 24 and a distal end adjacent the conveyor belt 34, is preferably inclined at an angled in the range of about 20 to about 45 degrees relative to the conveyor belt 34 to help carry the texturized yarn from the false twister 24 to the conveyor belt 34. In the preferred embodiment, the chute 42 includes an angle adjustor 66, which operably adjusts the angle the chute 42 is inclined relative to the conveyor belt 34. The distal end of the chute 42 can be rotationally secured adjacent the false twister 24 with a bolt 64.

The system 30 can also include a yarn bulker 36, as is well understood by those skilled in the art, positioned downstream from the compressor 40 and adjacent the yarn conveyor belt 34 to impart bulking of the bundle of compressed and spread texturized yarn Y2, e.g., through initial heating or steam treatment. The yarn bulker 36 can be of various configurations, types, and arrangements, but preferably allows the conveyor 34 to continue to move at high speed through the textured yarn production process.

Figure 2:
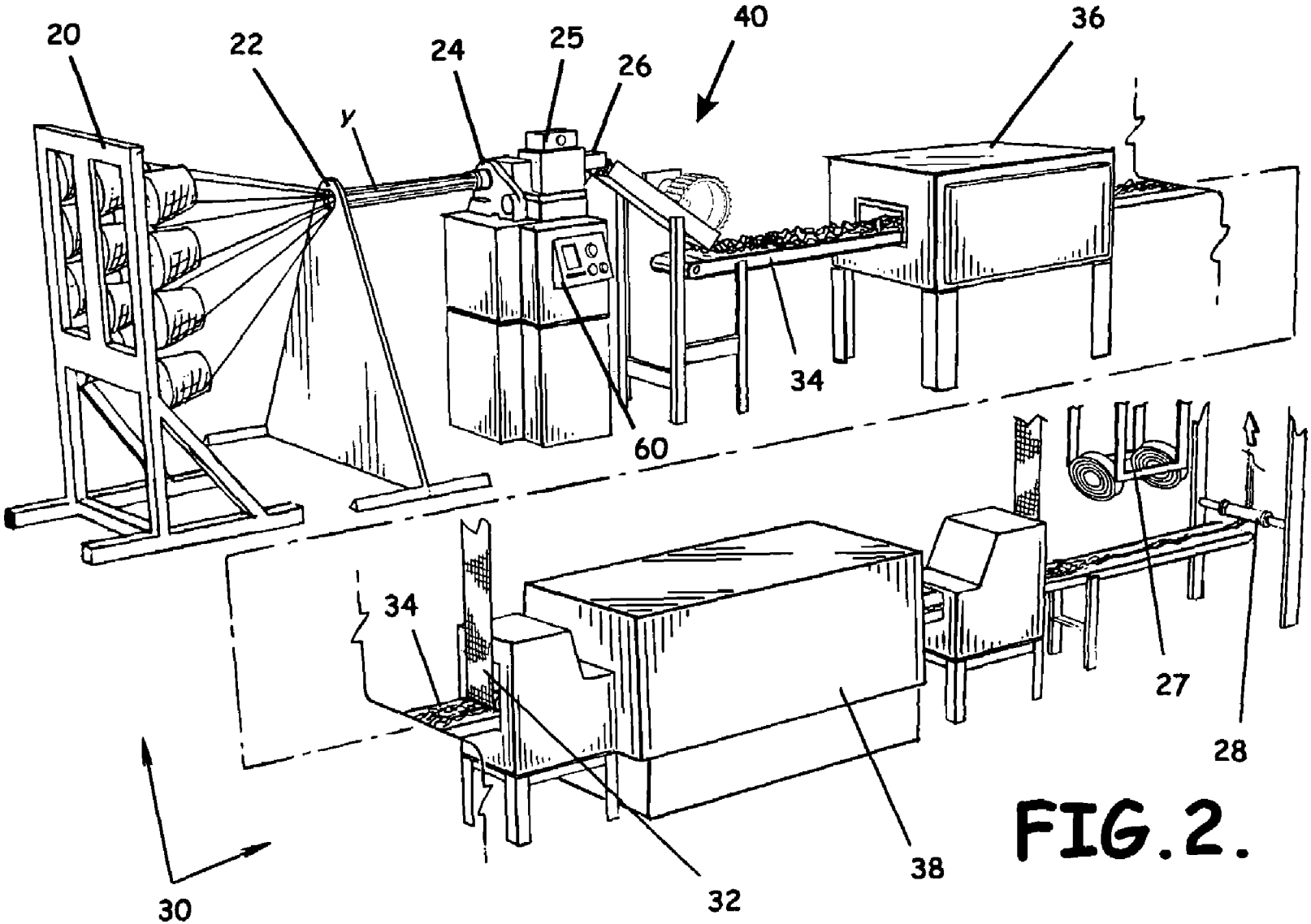
FIG. 2 is a perspective view of a system to reduce production loss in textured yarn according to an embodiment of the present invention.

As perhaps best shown in FIG. 2, the system 30 can also include a heat setting oven 38 positioned downstream from the compressor 40, and the bulker 36, so that the yarn belt conveyor 34 having the bundle of compressed and spread textured yarn Y2 thereon passes through the heat setting oven 38 to heat set the spaced and compressed textured yarn Y2 when passing therethrough. The system 30 can further include a yarn press belt 32 or band, e.g., formed of a mesh material, positioned to overlie the bundle of compressed and spread textured yarn Y2 prior to entry into the heat setting oven 38 to enhance press control or retaining of the bundle of compressed and spread textured yarn Y2 in maintaining its position on the conveyor belt 34, especially during high speed continuous production, and yet also allowing the bundle of compressed and spread textured yarn Y2 to be readily heated as it passes through the heat setting oven 38. Also, a yarn cooler 27, e.g., one or more fans and/or an air cooling distance on the conveyor belt 34, can be positioned downstream from the heat setting oven 38 to cool the bundle of compressed and spread textured yarn Y2 after passing through the heat setting oven 38, and a yarn take-up 28, e.g., driven by motors and controlled by the controller 60, if desired, can be positioned downstream from the heat setting oven 38 to take-up the cooled bundled compressed and spread textured yarn Y2 after being heat set as understood by those skilled in the art.

Figure 1:
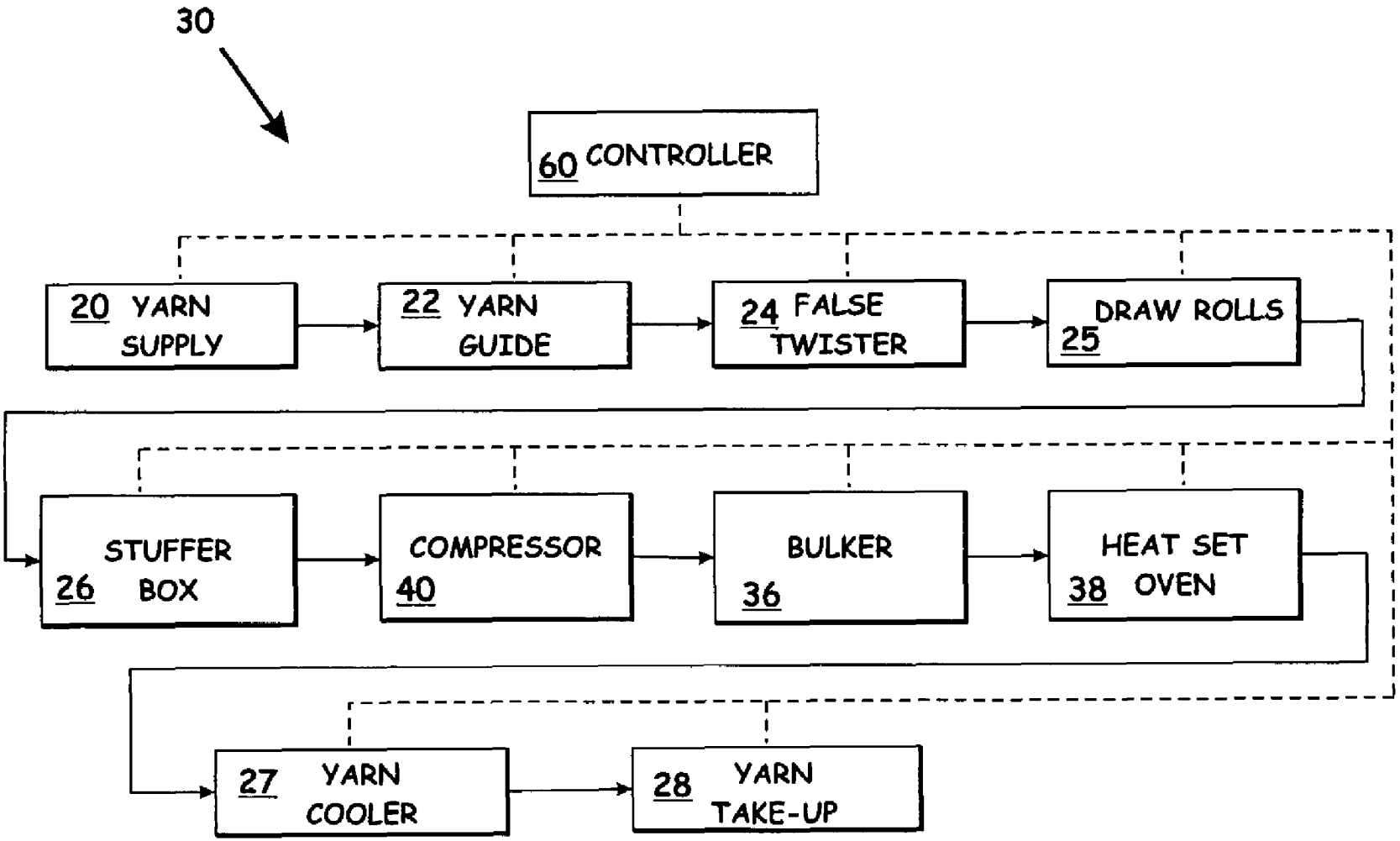
FIG. 1 is a schematic block diagram of a system to reduce production loss in textured yarn according to an embodiment of the present invention.

As illustrated in FIGS. 1-2, in a high speed continuous textured yarn production process, for example, the yarn draw 25 continuously draws the yarn Y from the yarn supply 20 at a selected speed responsive to the controller 60 as understood by those skilled in the art, and the yarn stuffing container 26 continuously periodically releases the textured yarn therefrom and into the chute 42. The compressor 40 continuously compresses and spreads the bundle of texturized yarn T,Y1 so the bundle of compressed and spread textured yarn Y2 exiting the compressor 40 is more uniformly spaced across the entire width of the chute 42. Also, the yarn conveyor belt 34 continuously receives the bundle of compressed and spread textured yarn Y2 thereon and continuously passes the textured yarn Y2 through the heat setting oven 38. The yarn take-up 28 likewise continuously takes up the textured yarn Y2 after the press belt 32 is removed and after heat set of the yarn occurs. As understood by those skilled in the art, single lines, such as shown in FIG. 2, or multiple lines of stuffing containers 26 and compressors 40 running in parallel as contemplated herein and by FIGS. 1 and 4, can be used according to embodiments of a system 30 of the present invention. Also, as understood by those skilled in the art, the yarn or tow can be of various sizes, and others as well, various plies, e.g., two ply, four ply, and other plies, various types, e.g., nylon, polyester, and other synthetics and wools, cottons, and other natural fiber yarns, counts, and twist levels as well.

Figure 3:
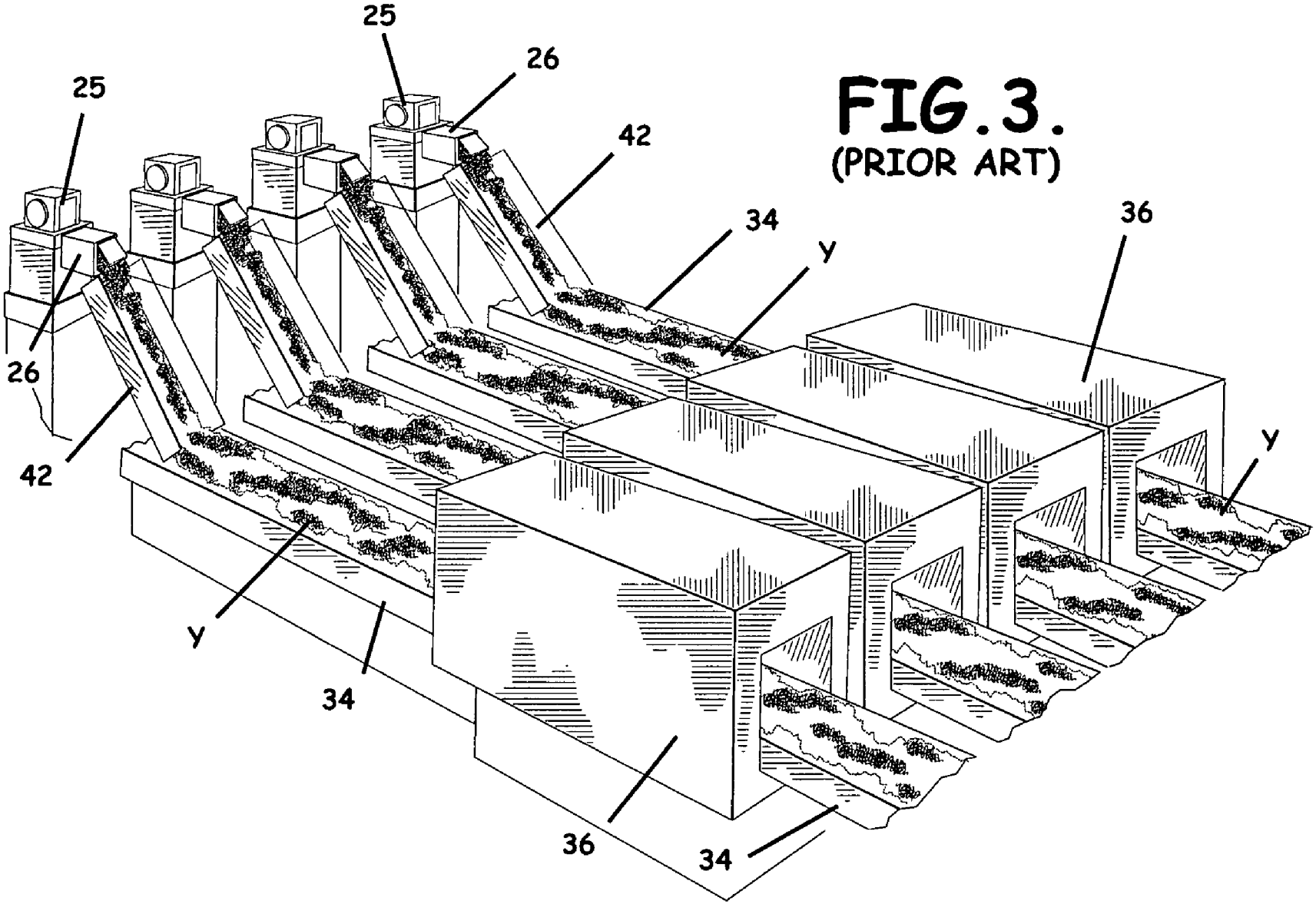
FIG. 3. (PRIOR ART)
FIG. 3 is a perspective view of a prior art system to produce textured yarn.
Figure 4:
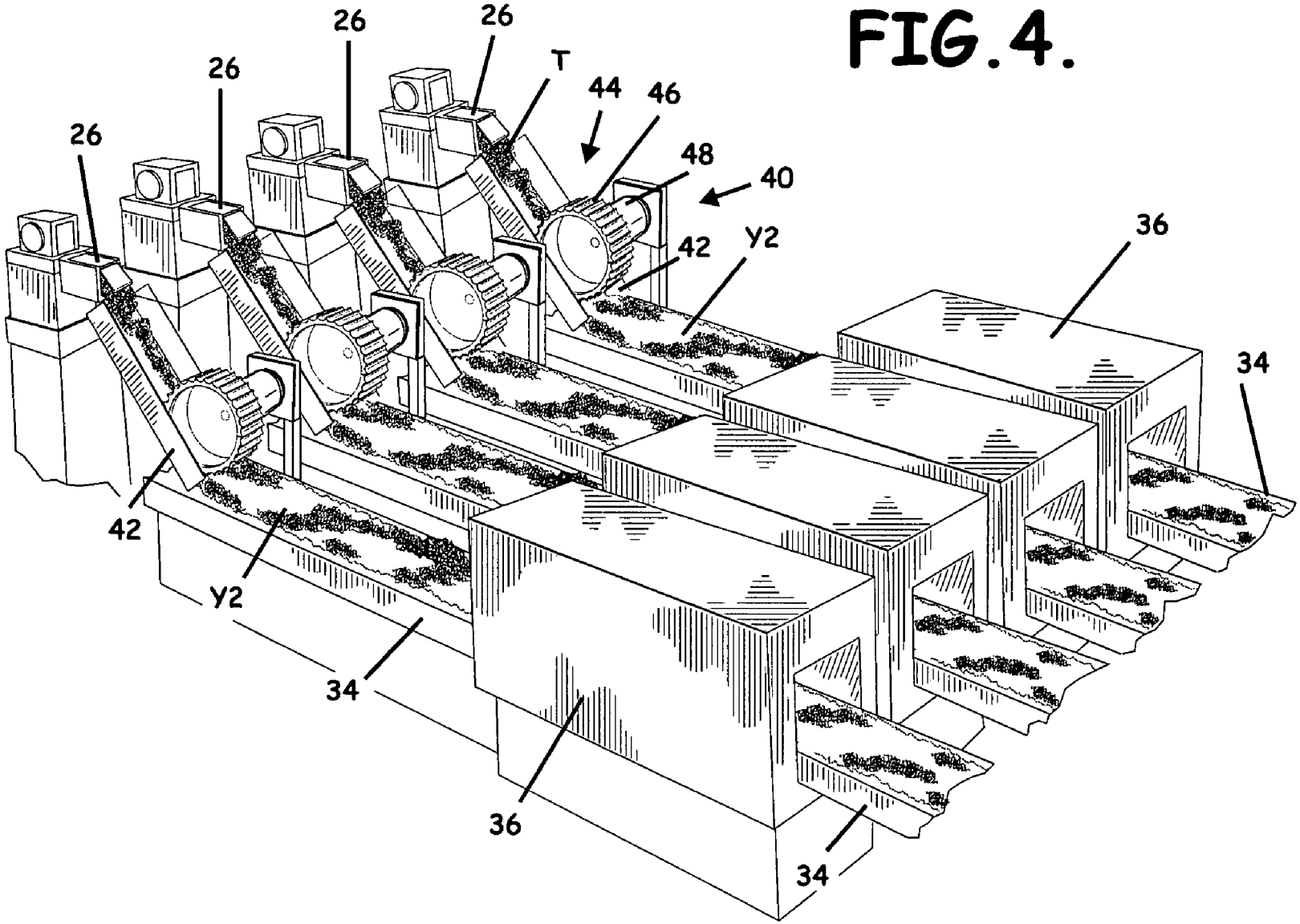
FIG. 4 is a perspective view of an embodiment of a system to reduce production loss in textured yarn according to an embodiment of the present invention.
Figure 5:
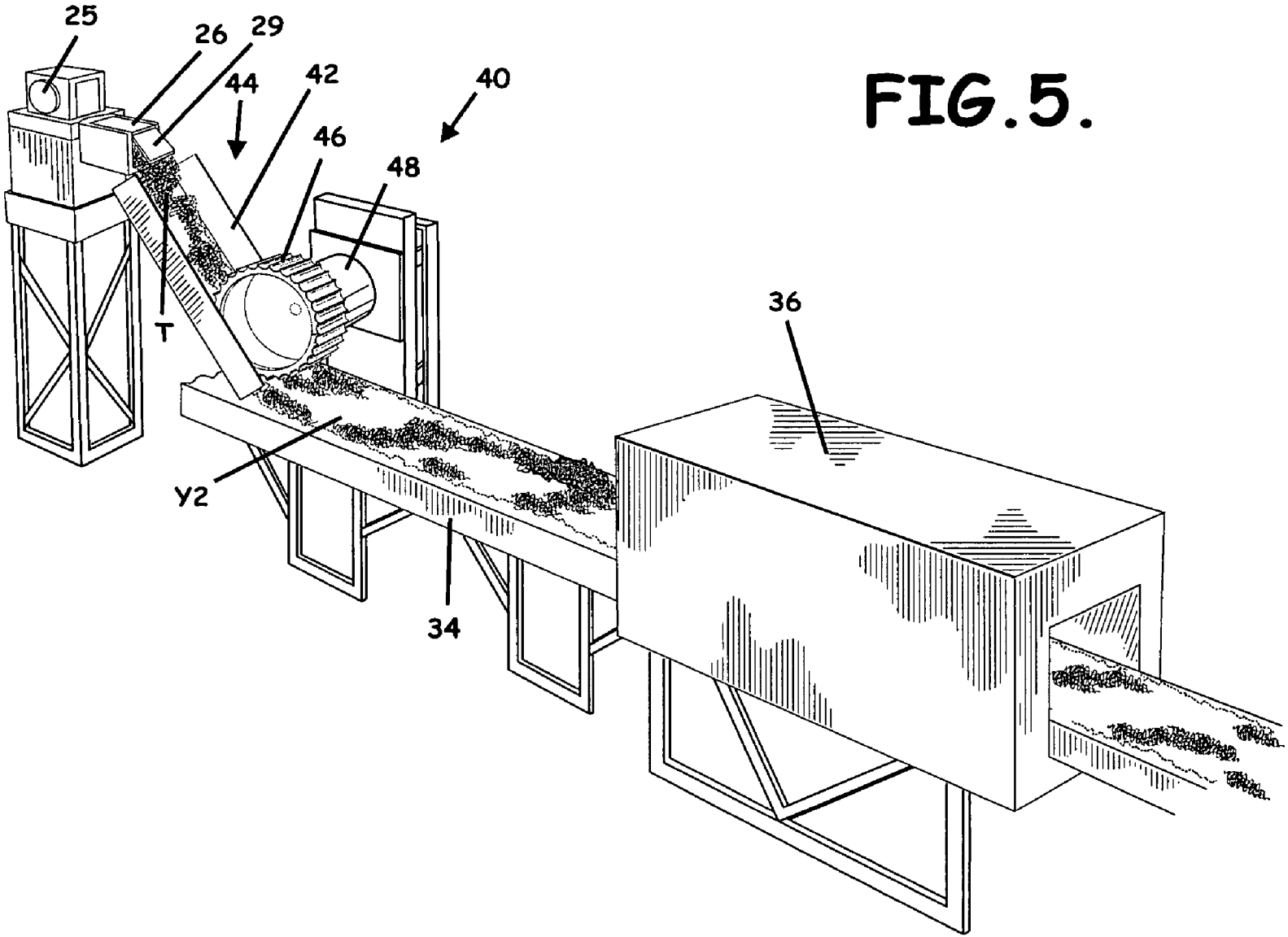
FIG. 5 is a perspective view of an embodiment of a system to reduce production loss in textured yarn according to an embodiment of the present invention.

As illustrated, the yarn conveyor belt 34 has a selected width of an upper surface portion thereof extending along a selected length of the upper surface portion. The textured yarn T has a yarn mass, and the yarn compressor assembly 44 substantially increases the yarn mass of the textured yarn per the selected length of the yarn conveyor belt 34 when deposited thereon (see FIGS. 11) and when the selected speed of the yarn draw is substantially increased over a system (see prior art FIG. 3) not having the yarn compressor assembly positioned between the yarn stuffing container and the yarn belt.

As illustrated in FIGS. 1-2 and 4-18, embodiments of the present invention also include yarn texturizing system 30 with a yarn texturizer (e.g., the draw rolls 25 and the stuffer box 26) to texturize yarn. The system 30 also includes a chute 42 positioned to receive and guide the texturized yarn in the form of a bundle of texturized yarn T from the yarn texturizer 25,26. A yarn compressor 40 is positioned to compress the texturized yarn T against an upper surface of the chute 42 at least after being initially received from the yarn texturizer 25,26. A yarn conveyor 34 is positioned to convey the compressed texturized yarn Y2.

The system 30 can also include that the yarn compressor 40 is further positioned adjacent the yarn conveyor 34, and a heat setting oven 38 positioned to receive compressed texturized yarn Y2 when positioned on the yarn conveyor 34 and moving to the heat setting oven 38 to be heat set therein. The system can also include that the yarn compressor 40 is positioned within at least a portion of the chute 42.

The compressor 40 can also be included as a component of a yarn compressor assembly 44, and the yarn compressor assembly 44 includes a motor drive 48 that selectively drives the compressor 40. The compressor assembly 44 also includes a compressor wheel 46 that compresses the texturized yarn T passing through the guide chute 42 by rotating with an outermost circumference of the compressor wheel 46 a preselected distance from the upper surface of the chute 42 carrying the texturized yarn T. The compressor wheel 46 can include a plurality of undulations substantially and uniformly positioned along an outer periphery of the surface of the compressor wheel 46. The undulations can include a plurality of compressor ridges 52 and compressor valleys 54, each compressor valley 54 being formed between each pair of adjacent compressor ridges 52, and the compressor ridges 52 defining the outermost circumference of the compressor wheel 46. The compressor ridges 52 and valleys 54 can also extend transverse to an axis A of the chute 42. The compressor ridges 52 and valleys 54 can extend in a predetermined pattern to spread the bundle of the texturized yarn T more uniformly across a width of the chute 42.

The chute 42 can also have a spacer vane 70 positioned to spread the bundle of the texturized yarn T prior to the texturized yarn being compressed, the spacer vane 70 includes a pair of inclined surfaces 72,74 extending upward and forming an apex 76 that extends along an axis A of the chute 42. The chute 42 can be positioned to extend between a proximal end adjacent the yarn texturizer 25,26 and a distal end adjacent the conveyor 34, and wherein the chute is inclined at an angle in the range of about 20 to about 45 degrees relative to the conveyor 34 to help carry the texturized yarn T from the yarn texturizer 25,26 to the conveyor 34. The chute 42 can also have an angle adjustor 66, which operably adjusts the angle the chute 42 is inclined relative to the conveyor 34.

The system can also include a yarn bulker 36 positioned adjacent the yarn conveyor 34, between the yarn compressor 40 and the heat setting oven 38, to impart bulking of the bundle of compressed and spread texturized yarn Y2 prior to entering the heat setting oven 38.

As illustrated in FIGS. 12 and 4-18, embodiments of the present invention also include a yarn compressor assembly 44 for use with a yarn texturizing system 30. The yarn compressor assembly 44 includes a chute 42 adapted to receive a bundle of texturized yarn T from a yarn texturizer 25,26 and guide the bundle of texturized yarn T to a conveyer 34. The yarn compressor assembly 44 also includes a motor-driven compressor 40 positioned to compress texturized yarn T,Y1 when passing through the guide chute 42, the compressor 40 has a compressor wheel 46 that compresses the bundle of texturized yarn T,Y1 passing through the chute 42 by rotating with an outermost circumference of the compressor wheel 46 a preselected distance from an upper surface of the chute 42 carrying the bundle of texturized yarn T,Y1.

The yarn compressor assembly 44 can also include that the compressor wheel 46 has a plurality of undulations substantially and uniformly positioned along an outer periphery of the surface of the compressor wheel 46. The undulations can include a plurality of compressor ridges 52 and compressor valleys 54 with each compressor valley 54 being formed between each pair of adjacent compressor ridges 52, and the compressor ridges 52 define the outermost circumference of the compressor wheel 46. The yarn compressor assembly 44 can also include that the compressor ridges 52 and valleys 54 extend transverse to an axis A of the chute 42. The yarn compressor assembly 44 can further include that the compressor ridges 52 and valleys 54 extend in a predetermined pattern to spread the bundle of texturized yarn T,Y1 more uniformly across a width of the chute 42.

The yarn compressor assembly 44 can also include that the chute 42 has a spacer vane 70 positioned to spread the bundle of texturized yarn T prior to the texturized yarn being compressed by the compressor wheel 46, and that the spacer vane 70 includes a pair of inclined surfaces 72,74 extending upward and forming an apex 76 that extends along an axis A of the chute 42. The yarn compressor assembly 44 can include that the chute 42 is positioned to extend between a proximal end adjacent the yarn texturizer 25,26 and a distal end adjacent the conveyor 34, and that the chute 42 is inclined at an angle in the range of about 20 to about 45 degrees relative to the conveyor 34 to help carry the texturized yarn from the yarn texturizer 25,26 to the conveyor 34. The yarn compressor assembly 44 can also include that the chute 42 includes an angle adjustor 66, which operably adjusts the angle the chute 42 is inclined relative to the conveyor 34. The yarn compressor assembly 44 can also include that the chute 42 has a pair of sidewalls 41,43 extending from the upper surface of the chute 42, and the compressor wheel 46 has about one-eighth of an inch clearance from the sidewalls 41,43 so that the compressor wheel 46 compresses the bundle of texturized yarn T.

As illustrated in FIGS. 1-2 and 4-18, embodiments of the present invention also include a method of controlling and increasing through put within a yarn texturizing system 30. The method includes carrying a bundle of texturized yarn T through a chute 42 extending between a yarn texturizer 25,26 and a yarn conveyor 34. The method also includes compressing the bundle of texturized yarn T,Y1, e.g. with a compressor 40, being received by and carried through the chute 42. The method also includes spreading the bundle of texturized yarn T,Y1, e.g. with the undulations on the compressor wheel 46 or with the spacer vane 70, so that a width of the bundle of texturized yarn T prior to being carried through the chute 42 is less than a width X of the bundle of texturized yarn Y2 exiting the chute 42. The method also includes conveying the compressed and spread texturized yarn Y2, e.g. with the conveyor belt 34, to a heat setting oven 38, and then heat setting the compressed and spread texturized yarn Y2.

The method can further include that the compressing step includes supplying a compressor 40 positioned closely adjacent an upper surface of the chute 42 so that the bundle of texturized yarn T,Y1 compresses when contacting the compressor 40. The method can also include that the compressor 40 has a compressor wheel 46 with undulations formed around the outer periphery of the compressor wheel 46 so that the undulations compress and spread the bundle of texturized yarn T,Y1. The method can further include controlling a preselected distance from each edge of the conveyor 34 that the compressed and spread texturized yarn Y2 is positioned by defining a width of the chute 42 that is less than a width of the conveyor 34, and substantially uniformly spreading the bundle of texturized yarn Y2 across the width of the chute 42 during the spreading step.

In the drawings and specification, there have been disclosed various illustrated embodiments of the invention and, although specific terms are employed, they are used in a generic and descriptive sense only and not for the purpose of limitation, the scope of the invention being set forth in the following claims.

The invention claimed is:

1. A yarn texturizing system comprising:

a yarn texturizer to texturize yarn;

a chute positioned to receive and guide the texturized yarn in the form of a bundle of texturized yarn from the yarn texturizer;

a yarn compressor positioned to compress the texturized yarn against an upper surface of the chute at least after being initially received from the yarn texturizer; and a yarn conveyor positioned to convey the compressed texturized yarn.

2. A system as defined in claim 1, wherein the yarn compressor is further positioned adjacent the yarn conveyor, and the system further includes a heat setting oven positioned to receive compressed texturized yarn when positioned on the yarn conveyor and moving to the heat setting oven to be heat set therein.

3. A system as defined in claim 1, wherein the yarn compressor is positioned within at least a portion of the chute.

4. A system as defined in claim 3, wherein the compressor is included as a component of a yarn compressor assembly, the yarn compressor assembly further comprising:

a motor drive that selectively drives the compressor; and a compressor wheel that compresses the texturized yarn passing through the guide chute by rotating with an outermost circumference of the compressor wheel a preselected distance from the upper surface of the chute carrying the texturized yarn.

5. A system as defined in claim 4, wherein the compressor wheel includes a plurality of undulations substantially and uniformly positioned along an outer periphery of the surface of the compressor wheel.

6. A system as defined in claim 5, wherein the undulations include a plurality of compressor ridges and compressor valleys each compressor valley being formed between each pair of adjacent compressor ridges, the compressor ridges defining the outermost circumference of the compressor wheel.

7. A system as defined in claim 6, wherein the compressor ridges and valleys extending transverse to an axis of the chute.

8. A system as defined in claim 7, wherein the compressor ridges and valleys extend in a predetermined pattern to spread the bundle of the texturized yarn more uniformly across a width of the chute.

9. A system as defined in claim 1, wherein the chute further comprises a spacer vane positioned to spread the bundle of the texturized yarn prior to the texturized yarn being compressed, the spacer vane including a pair of inclined surfaces extending upward and forming an apex that extends along an axis of the chute.

10. A system as defined in claim 1, wherein the chute is positioned to extend between a proximal end adjacent the yarn texturizer and a distal end adjacent the conveyor, and wherein the chute is inclined at an angle in the range of about 20 to about 45 degrees relative to the conveyor to help carry the texturized yarn from the yarn texturizer to the conveyor.

11. A system as defined in claim 10, wherein the chute further comprises an angle adjustor, which operably adjusts the angle the chute is inclined relative to the conveyor.

12. A system as defined in claim 2, further comprising a yarn bulker positioned adjacent the yarn conveyor, between the yarn compressor and the heat setting oven, to impart bulking of the bundle of compressed and spread texturized yarn prior to entering the heat setting oven.

13. A yarn compressor assembly for use with a yarn texturizing system comprising:

a chute adapted to receive a bundle of texturized yarn from a yarn texturizer and guide the bundle of texturized yarn to a conveyer; and a motor-driven compressor positioned to compress texturized yarn when passing through the guide chute, the compressor having a compressor wheel that compresses the bundle of texturized yarn passing through the chute by rotating with an outermost circumference of the compressor wheel a preselected distance from an upper surface of the chute carrying the bundle of texturized yarn.

14. A yarn compressor assembly as defined in claim 13, wherein the compressor wheel includes a plurality of undulations substantially and uniformly positioned along an outer periphery of the surface of the compressor wheel.

15. A yarn compressor assembly as defined in claim 14, wherein the undulations include a plurality of compressor ridges and compressor valleys each compressor valley being formed between each pair of adjacent compressor ridges, the compressor ridges defining the outermost circumference of the compressor wheel.

16. A yarn compressor assembly as defined in claim 15, wherein the compressor ridges and valleys extending transverse to an axis of the chute.

17. A yarn compressor assembly as defined in claim 16, wherein the compressor ridges and valleys extend in a predetermined pattern to spread the bundle of texturized yarn more uniformly across a width of the chute.

18. A yarn compressor assembly as defined in claim 17, wherein the chute further comprises a spacer vane positioned to spread the bundle of texturized yarn prior to the texturized yarn being compressed by the compressor wheel, the spacer vane including a pair of inclined surfaces extending upward and forming an apex that extends along an axis of the chute.

19. A yarn compressor assembly as defined in claim 13, wherein the chute is positioned to extend between a proximal end adjacent the yarn texturizer and a distal end adjacent the conveyor, and wherein the chute is inclined at an angle in the range of about 20 to about 45 degrees relative to the conveyor to help carry the texturized yarn from the yarn texturizer to the conveyor.

20. A yarn compressor assembly as defined in claim 19, wherein the chute further comprises an angle adjustor, which operably adjusts the angle the chute is inclined relative to the conveyor.

21. A yarn compressor assembly as defined in claim 13, wherein the chute includes a pair of sidewalls extending from the upper surface of the chute, the compressor wheel having about one-eighth of an inch clearance from the sidewalls so that the compressor wheel compresses the bundle of texturized yarn.

22. A method of controlling and increasing through put within a yarn texturizing system, the method comprising:

carrying a bundle of texturized yarn through a chute extending between a yarn texturizer and a yarn conveyor;

compressing the bundle of texturized yarn being carried through the chute;

spreading the bundle of texturized yarn so that a width of the bundle of texturized yarn prior to being received by the chute is less than a width of the bundle of texturized yarn exiting the chute;

conveying the compressed and spread texturized yarn to a heat setting oven; and heat setting the compressed and spread texturized yarn.

23. A method as defined in claim 22, wherein the compressing step includes supplying a compressor positioned closely adjacent an upper surface of the chute so that the bundle of texturized yarn compresses when contacting the compressing device.

24. A method as defined in claim 23, wherein the compressor includes a compressor wheel having undulations formed around the outer periphery of the compressor wheel so that the undulations compress and spread the bundle of texturized yarn.

25. A method as defined in claim 22, further comprising controlling a preselected distance from each edge of the conveyor that the compressed and spread texturized yarn is positioned by defining a width of the chute that is less than a width of the conveyor, and substantially uniformly spreading the bundle of texturized yarn across the width of the chute during the spreading step.

* * * * *